US010858793B1

(12) United States Patent
Hoard

(10) Patent No.: US 10,858,793 B1
(45) Date of Patent: Dec. 8, 2020

(54) SNOW AND ICE COVERED SURFACE AERATORS AND METHODS OF USE

(71) Applicant: Robert H. Hoard, Granville, NY (US)

(72) Inventor: Robert H. Hoard, Granville, NY (US)

( * ) Notice: Subject to any disclaimer, the term of this patent is extended or adjusted under 35 U.S.C. 154(b) by 0 days.

(21) Appl. No.: 16/844,012

(22) Filed: Apr. 9, 2020

Related U.S. Application Data

(60) Provisional application No. 62/847,627, filed on May 14, 2019.

(51) Int. Cl.
*E01H 5/10* (2006.01)
*E01H 1/08* (2006.01)

(52) U.S. Cl.
CPC ..... *E01H 5/102* (2013.01); *E01H 1/0809* (2013.01)

(58) Field of Classification Search
CPC ..... A01B 45/02; A01B 45/023; A01B 1/243; E01H 5/102
USPC ..... 126/343.5 R; 172/21, 554
See application file for complete search history.

(56) References Cited

U.S. PATENT DOCUMENTS

| | | | |
|---|---|---|---|
| 3,834,549 A | 9/1974 | Burg et al. | |
| 4,161,088 A | 7/1979 | Gugliotta et al. | |
| 4,274,222 A | 6/1981 | Zahn et al. | |
| 4,438,615 A | 3/1984 | Wendel | |
| 5,636,491 A | 6/1997 | Schärer et al. | |
| 6,641,453 B1 | 11/2003 | Morales et al. | |
| 8,292,687 B2 | 10/2012 | Tremblay et al. | |
| 9,664,512 B2 | 5/2017 | Srinivasan | |
| 2006/0213595 A1* | 9/2006 | Volt | B60C 11/1606 152/210 |

FOREIGN PATENT DOCUMENTS

| | | |
|---|---|---|
| GB | 2192965 A | 1/1988 |
| WO | WO90/05854 A | 5/1990 |

OTHER PUBLICATIONS

Vavrek, Bob,"Winterkill-Causes and Prevention," USGA Green Section Record, vol. 54 (15), Aug. 5, 2016.
Dionne, Julie, "Winter Protection of Annual Bluegrass Golf Greens," USGA Green Section Record, Sep./Oct. 2000.

* cited by examiner

*Primary Examiner* — Vivek K Shirsat
(74) *Attorney, Agent, or Firm* — Tech Valley Patent, LLC; John Pietrangelo

(57) ABSTRACT

Aerators and methods for aerating snow and/or ice-covered surfaces, such as, golf greens or lawns, are provided. The aerators include a hub and cylindrical projections from the hub. The cylindrical protections are shaped and oriented to contact the snow and/or ice covered surface. Upon distribution of the aerators upon a snow and/or ice covered surface and exposure of the aerators to ambient conditions, such as, the sun, the temperature of the projections is raised above freezing which melts adjacent portions of the snow and/or ice to expose portions of the underlining surface to ambient air. A kit providing aerators is also provided.

20 Claims, 8 Drawing Sheets

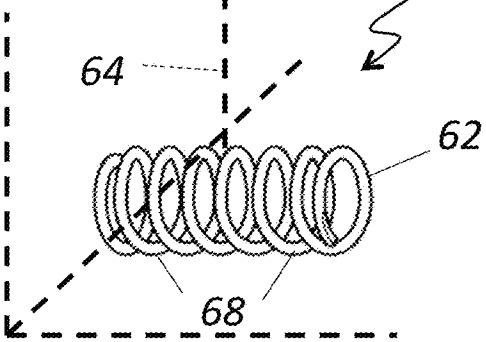
Fig. 9
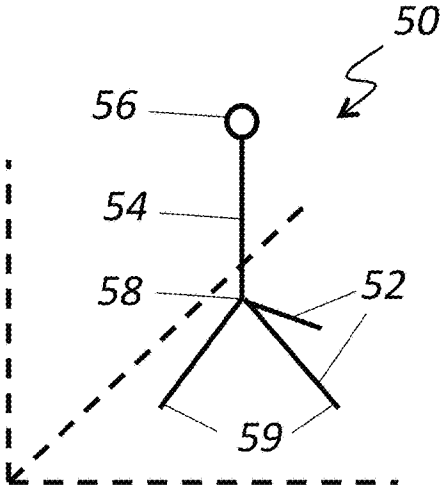
Fig. 10
Fig. 11
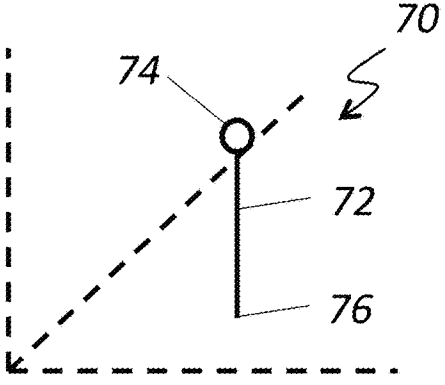
Fig. 12
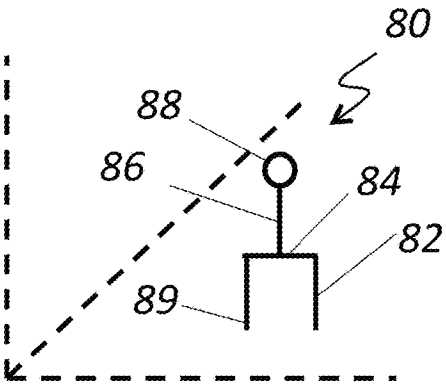
Fig. 13
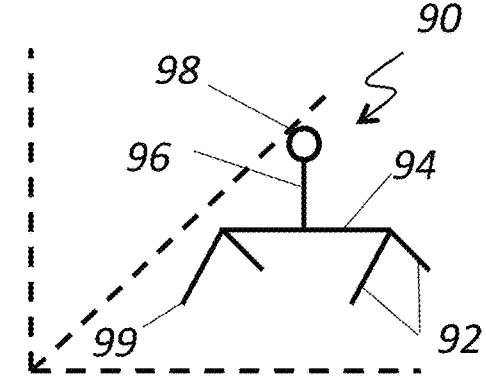
Fig. 14

SNOW AND ICE COVERED SURFACE AERATORS AND METHODS OF USE

CROSS-REFERENCE TO RELATED APPLICATION

This application claims priority from U.S. Provisional Patent Application 62/847,627, filed on May 14, 2019, the disclosure of which is included by reference herein in its entirety.

BACKGROUND OF THE INVENTION

Technical Field

The present invention is related to aerating surfaces covered with ice and/or snow that can benefit from exposure to the ambient environment. In particular, the invention is related to aerating surfaces having vegetation, such as, grass, that is restricted from desired aeration due to the presence of ice and/or snow upon the surface.

Description of Related Art

The presence of ice and/or snow on some surfaces, such as, surfaces having vegetation, can cause damage to the surface. For example, grass lawns and golf greens can be damaged due to ice or snow cover due to grass "suffocation." Studies have shown that grasses on golf greens and fairways can cause grass die "from lack of oxygen or the buildup of toxic gases." (Vavrek, 2016).

Some success has been achieved in minimizing or preventing grass or turf damage through chemical treatment of grass, for example, to enrich the nitrogen content of the grass, or by placing protective covers over the vulnerable grass surfaces. (Dionne, 2000). However, it is understood that these existing practices have yielded limited success.

The present invention and its many aspects were developed to address this need, and provide methods and devices for, among other things, reducing or eliminating ice and/or snow damage to surface, such as, grass surfaces.

SUMMARY OF THE INVENTION

After recognizing the limitations and disadvantages of the existing methods and devices for minimizing ice and/or snow damage to surfaces, for example, grass surfaces, the present invention and its many aspects were conceived and developed. According to aspects of the invention, pathways through ice and/or snow covered surfaces to the underlying surface, for example, underlying grass surface, are provided by distributing "aerators" upon the vulnerable surfaces before or after the development of or precipitation of the ice and/or snow. According to an aspect of the invention, the aerators include a plurality of projections or pins that, due to, for example, ambient heating, maintain or generate perforations or pathways from the ambient air to the underlying surface. These perforations or pathways can allow, for example, oxygen to access the underlying surface and/or allow any toxic gases to be vented from the underlying surface to minimize or prevent damage to the surface.

One embodiment of the invention is a method for aerating a surface covered with ice and/or snow, the method comprising or including: prior to or after accumulation of snow or formation of ice upon the surface, distributing a plurality of aerators, as disclosed herein, on to the surface or on to a top of the snow or ice, each of the plurality of aerators comprising a body having at least three projections oriented to contact the surface, to contact the top of the accumulation of snow, or to the top of the formation of ice; exposing the aerators to ambient conditions wherein a temperature of at least a portion of one of the projections is increased to a temperature above freezing, wherein at least a portion of one of the projections melts a portion of the snow or ice exposing at least a portion of the surface to ambient air; and allowing ambient air to access the exposed portion of the surface to aerate the exposed portion of the surface. In one aspect, the plurality of aerators may be distributed on to the surface, for example, on to a surface of a golf green. In another aspect, the plurality of aerators may be distributed on to the surface of the ice and/or snow. In another aspect, exposing the aerators to ambient conditions comprises exposing the aerators to solar radiation.

Another embodiment of the invention is a device, or an aerator, for aerating a surface covered with ice and/or snow. The aerator may comprise or include a body having at least three projections oriented to contact the surface, to contact a top of the accumulation of snow, or to a top of the formation of the ice, wherein exposure of the aerator to ambient conditions raises a temperature of at least a portion of one of the projections above a freezing temperature wherein at least a portion of one of the heated projections melts at least a portion of the snow or ice exposing at least a portion of the surface to ambient air. In one aspect, the body of the aerator may have a hub and the at least three projections are mounted to or project from the hub. In another aspect, exposure of the aerator to ambient conditions may raise the temperature of at least a portion of each of the projections above the freezing temperature. In one aspect, exposure of the aerator to ambient conditions may raise the temperature of at least a distal end portion of each of the projections above the freezing temperature. In one aspect, the at least three projections of the aerator may be at least 4 projections.

A further aspect of the invention is a kit for aerating a surface covered with ice or snow, the kit comprising or including a plurality of aerators, as disclosed herein, each of the plurality of aerators having a body having at least three projections oriented to contact the surface, to contact the top of the accumulation of snow, or to a top of the formation of the ice. In one aspect, the kit may further include a linkage or a filament, for example, a chain or wire, adapted to link each of the plurality of aerators. In another aspect, the kit may include instructions for using the kit.

These and other aspects, features, and advantages of this invention will become apparent from the following detailed description of the various aspects of the invention taken in conjunction with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention will be readily understood from the following detailed description of aspects of the invention taken in conjunction with the accompanying drawings in which:

FIGS. 9 through 14 are schematic perspective views of aerators according to other aspects of the invention.

DETAILED DESCRIPTION OF THE INVENTION

Figure 1:
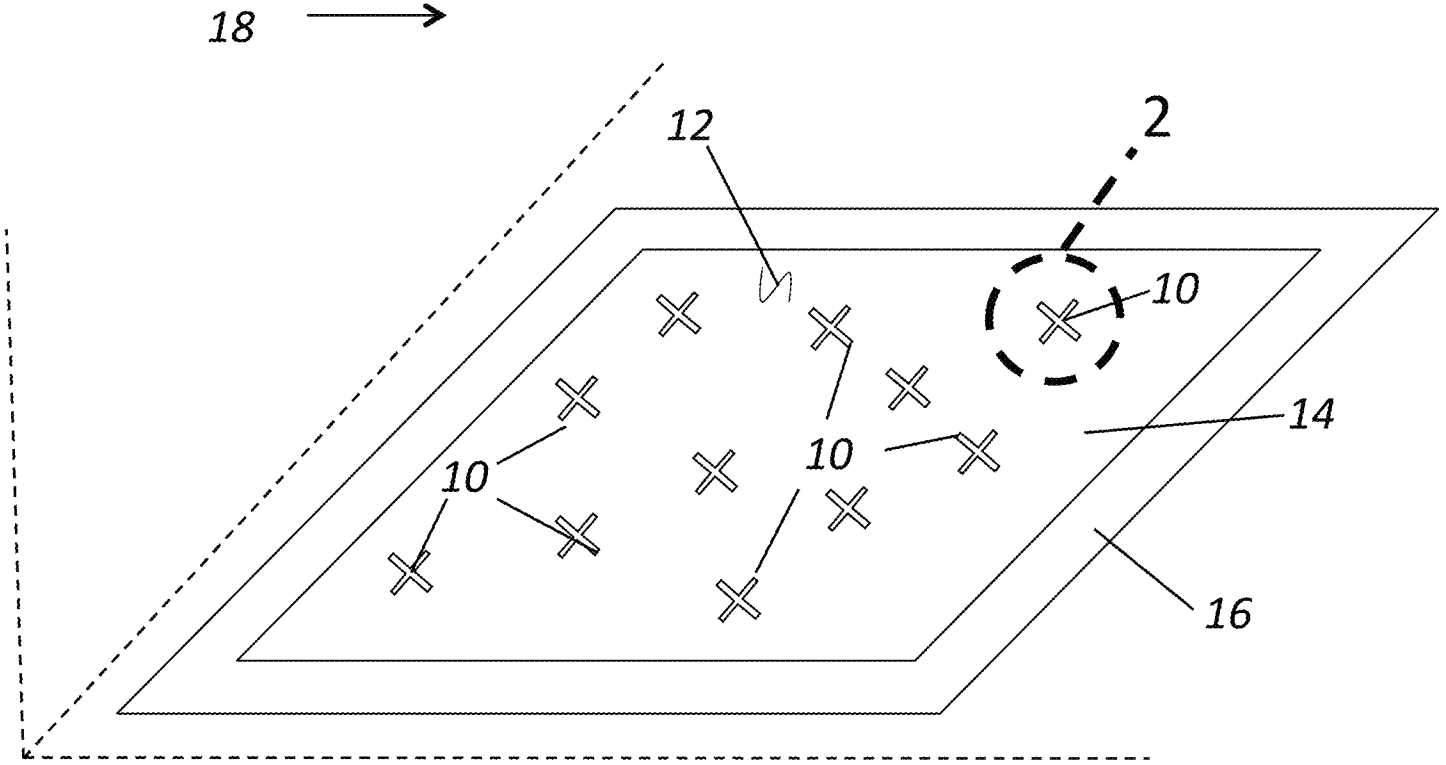
FIG. 1 is a schematic perspective view of one aspect of the invention.

FIG. 1 is a schematic perspective view of one aspect of the invention. As shown in FIG. 1, according to this aspect of the invention, one or more, but typically, a plurality, of pronged or spiked bodies 10 may be distributed upon a surface 12 of a layer of ice and/or snow 14 which covers a surface 16, for example, a surface that is desirable to aerate. In one aspect, surface 16 may be a vegetative surface, for example, a grass surface of, for instance, a putting green, tee box, or a fairway of a golf course, though pronged or spiked bodies 10 may be used to aerate other surfaces that can benefit from aeration.

As will be discussed below, according to aspects of the invention, the projections, extensions, or prongs of pronged body 10 may be used to penetrate the ice and/or snow layer 14 to at least partially expose surface 16 to, for example, ambient air 18, for example, ambient air above surface 12. As disclosed herein, pronged body 10 may comprise many different shapes and sizes while providing the desired penetration of layer 14 and aeration of surface 16. Therefore, for the sake of facilitating the disclosure of the invention in its many aspects, in the following discussion, pronged or spiked bodies 10 may be referred to by the non-limiting terms "aerator," "an aerator," and/or "aerators."

Figures 2, 3, 4:
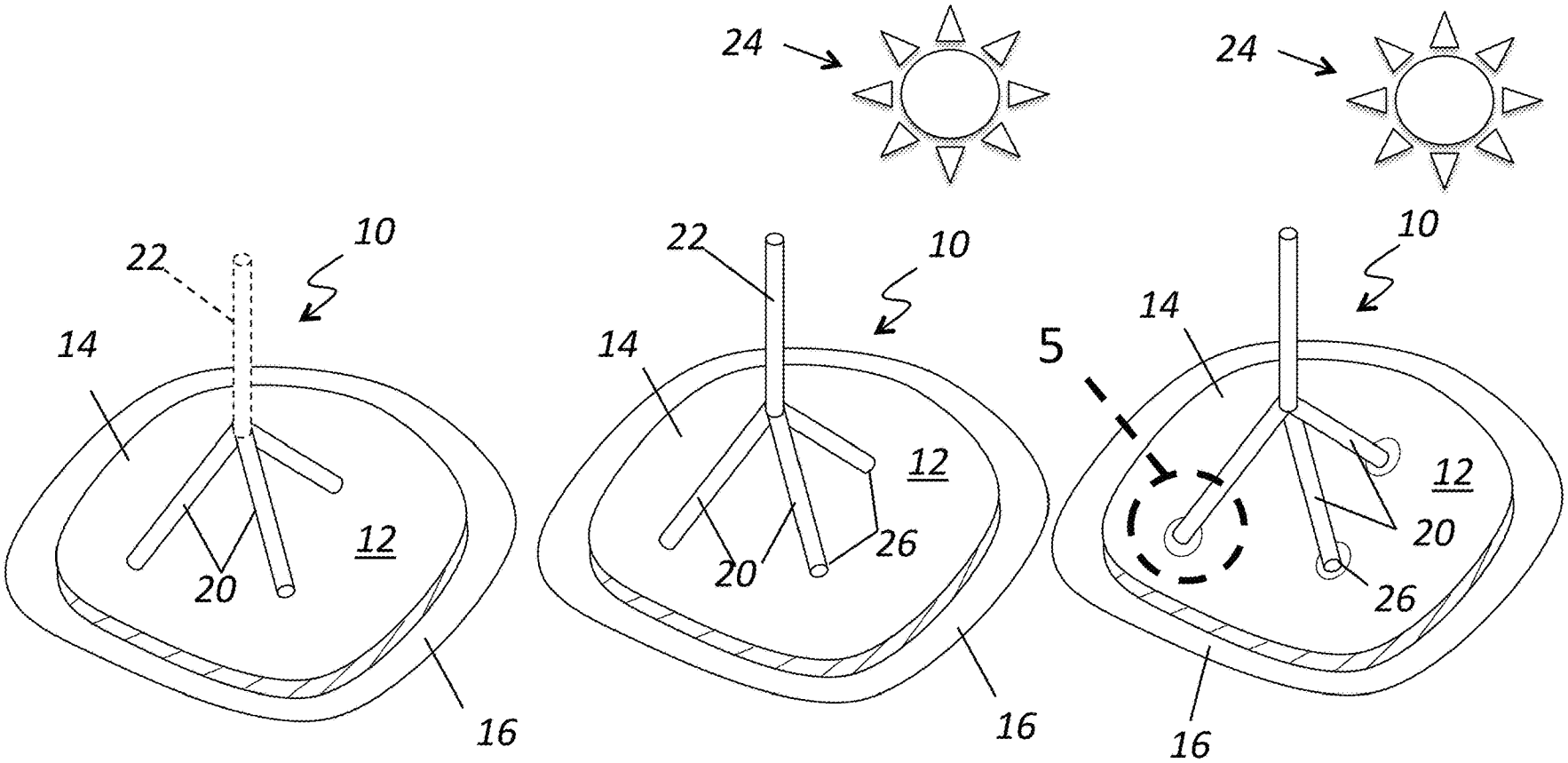
FIG. 2 is a detailed perspective view of one of the aerators shown in FIG. 1, as identified by Detail 2 in FIG. 1, according to one aspect of the invention.
FIG. 3 is a detailed perspective view of the aerator shown in FIG. 2 when exposed to ambient conditions according to one aspect of the invention.
FIG. 4 is a detailed perspective view of the aerator shown in FIG. 3 after exposure to ambient conditions according to one aspect of the invention.

FIG. 2 is a detailed perspective view of one of aerator 10 shown in FIG. 1, as identified by Detail 2 in FIG. 1, according to one aspect of the invention. As shown in FIG. 2, aerator 10 may typically comprise or include at least one, but typically, a plurality of prongs, "legs," spires, spikes, or projections 20. In the aspect of the invention shown in FIG. 2, aerator 10 is shown having 3 projections 20, though 1 or more or 2 or more projections 20 may be provided in some aspects.

As shown in FIG. 2, aerator 10 may be placed or be positioned on surface 12 of ice and/or snow layer 14, where ice and/or snow layer 14 is formed, for example, by precipitation or freezing, upon surface 16. According to an aspect of the invention, while resting or being positioned on surface 12, one or more of the projections 20 of aerator 10 contact or are positioned against surface 12. In one aspect, one or more projections 20 may at least partially penetrate surface 12. As also shown in FIG. 2, aerator 10 may optionally include one or more projections 22 (shown in phantom in FIG. 2) that, when aerator 10 is positioned on surface 12 may not contact surface 12. In one aspect, one or more projections 22 may be directed away from surface 12, and, in one aspect, may provide a means for handling aerator 10.

FIG. 3 is a detailed perspective view of the aerator 10 shown in FIG. 2 when aerator 10 is exposed to ambient conditions, for example, ambient temperature, such as, ambient air heated by solar radiation from the sun 24. According to aspects of the invention, the heating or warming of aerator 10, or at least the heating or warming of projections 20 of aerator 10, raises the temperature of projection 20, and/or at least raises the temperature of the distal ends 26 of projection 20, where the distal ends 26 of projections 20 in contact with the surface 12 begin to melt the area of surface 12 in contact with the distal ends 26 of projections 20. In one aspect, the projections 20 of aerator 10 may typically absorb thermal energy from the ambient conditions and then distribute, conduct, or radiate the absorbed thermal energy from projections 20 to melt adjacent ice and/or snow of layer 14.

FIG. 4 is a detailed perspective view of aerator 10 shown in FIG. 3 after exposure of at least the distal ends 26 of projections 20 to ambient conditions according to one aspect of the invention. As shown in FIG. 4, with the relative heating of projections 20, at least the distal ends 26 of projection 20 melt, for example, locally melt, portions of surface 12 to produce depressions in layer 14 and then penetrations through layer 14 to expose portions of surface 16 beneath ice and/or snow layer 14. Though in one aspect, only the distal ends 26 of projections 20 may penetrate ice and/or snow layer 14, in one aspect, a substantial portion of projections 20 may penetrate layer 14, for example, the entire projection 20 may penetrate layer 14, and it is conceivable that in one aspect, substantially the entire aerator 10 may penetrate layer 14.

Figure 5:
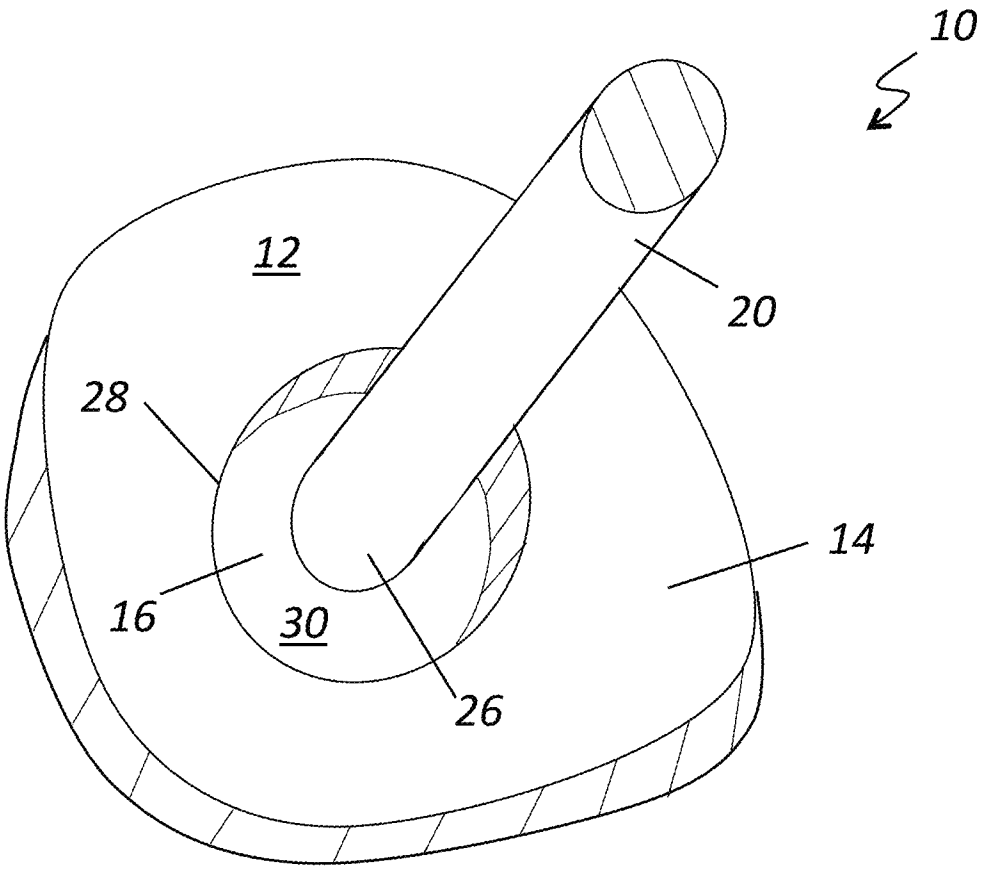
FIG. 5 is a detailed perspective view of one distal end of the aerator shown in FIG. 4, as identified by Detail 5 in FIG. 4, according to one aspect of the invention.

FIG. 5 is a detailed perspective view of one distal end 26 of the projection 20 shown in FIG. 4, as identified by Detail 5 in FIG. 4, according to one aspect of the invention. As shown in FIG. 5, after the distal end 26 of at least one projection 20 locally melts layer 14 about distal end 26 and produces a penetration 28 in layer 14, a portion 30 of surface 16 is exposed to ambient air.

According to aspects of the invention, the exposure of portions 30 of surface 16 to ambient air through penetrations 28 may be beneficial to the surface 16, or beneficial to at least the portions 30 exposed through penetrations 28. For example, in one aspect, surface 16 beneath ice and/or snow layer 14 may benefit from exposure to ambient air, for example, to expose portions 30 of surface 16 to the oxygen and/or nitrogen in the ambient air. In one aspect, surface 16 may be a surface of vegetation, for example, grass that can benefit from the exposure to oxygen, carbon dioxide, or nitrogen in the ambient air. In another aspect, the exposure of at least portions 30 of surface 16 may benefit by allowing the escape or venting of fluids from surface 16 to ambient air, for example, the escape or venting of liquids, such as, water, or of gases, such as, water vapor or toxic gases, from surface 16.

Figures 6, 7, 8:
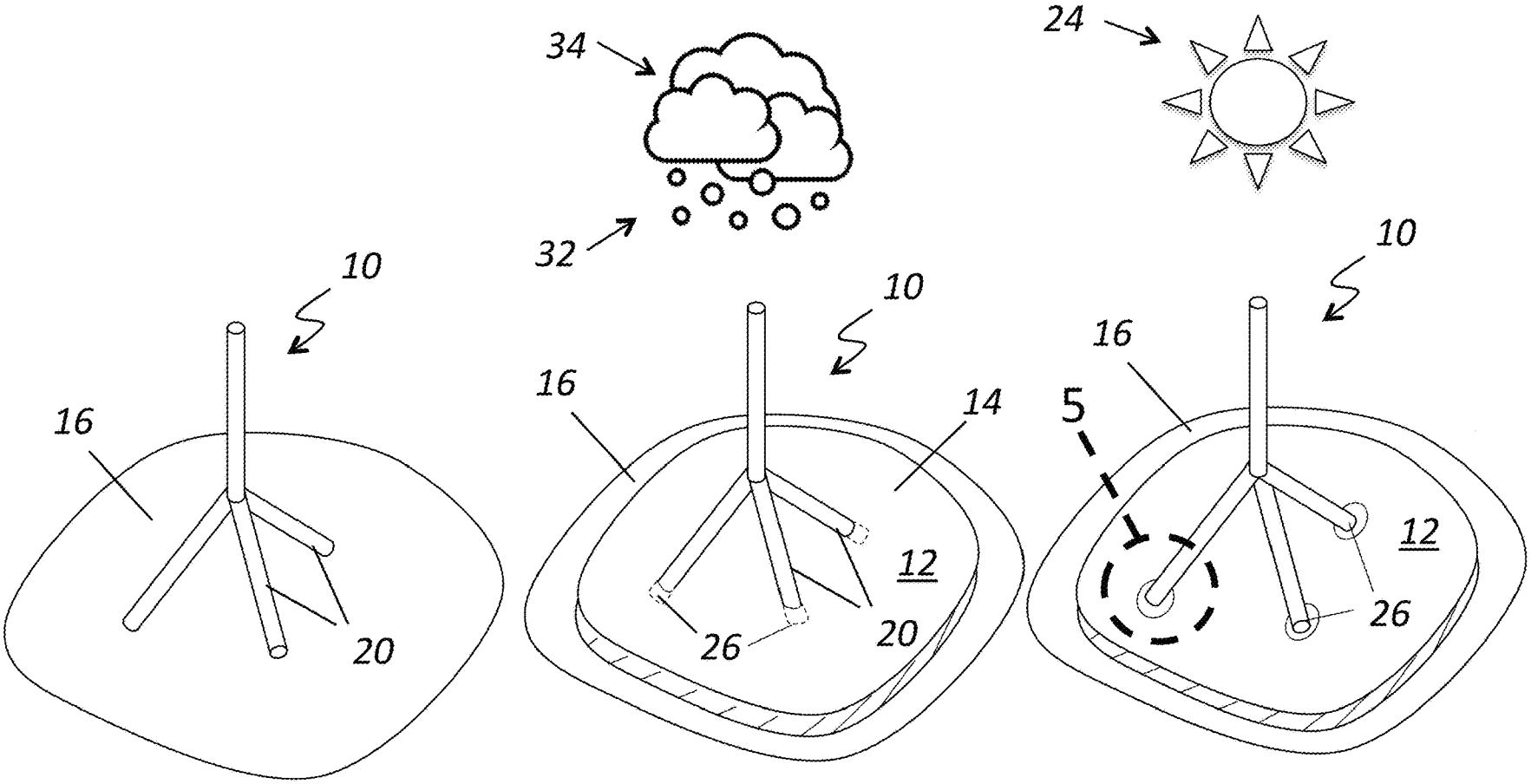
FIG. 6 is a detailed perspective view of one of the aerators shown in FIG. 1, as identified by Detail 2 in FIG. 1, prior to accumulation of ice and/or snow according to one aspect of the invention.
FIG. 7 is a detailed perspective view of the aerator shown in FIG. 6 after accumulation of ice and/or snow according to one aspect of the invention.
FIG. 8 is a detailed perspective view of the aerator shown in FIG. 7 after exposure to ambient conditions according to one aspect of the invention.

FIG. 6 is a detailed perspective view of one of aerator 10 shown in FIG. 1, as identified by Detail 2 in FIG. 1, but prior to accumulation of ice and/or snow layer 14 according to one aspect of the invention. In the aspect of the invention shown in FIG. 6, one or more, but, typically, a plurality of aerators 10 having projections 20 may be distributed or placed upon surface 16, such as, a golf green, prior to the accumulation of ice and/or snow layer 14 on surface 16 and provide the benefits of aspects of the invention, for example, the aeration of surface 16.

FIG. 7 is a detailed perspective view of the aerator 10 shown in FIG. 6 after accumulation of ice and/or snow layer 14 having surface 12 upon surface 16 according to one aspect of the invention. As shown in FIG. 7, layer 14 may be provided by precipitation 32, for example, snow or sleet from clouds 34, and/or from the freezing of water, for example, from surface discharge or ground water, upon surface 16. As also shown in FIG. 7, with the accumulation of ice and/or snow layer 14 upon surface 16, the distal ends 26 of projections 20 may be covered by or submerged within layer 14, for example, prior to the heating of projections 20 by ambient temperature or solar radiation.

FIG. 8 is a detailed perspective view, similar to FIG. 4, of aerator 10 shown in FIG. 7 after exposure to ambient conditions according to one aspect of the invention. As shown in FIG. 8, after exposure of at least the distal ends 26 of projections 20 to ambient conditions according to one aspect of the invention, and the relative heating or warming of projections 20, at least the distal ends 26 of projection 20 may melt, for example, locally melt, portions of ice and/or snow layer 14 to produce penetrations 26 through layer 14 to expose portions of surface 16 beneath ice and/or snow layer 14. As shown in FIG. 8, the resulting penetrations provided in the aspect of the invention shown in FIGS. 6, 7, and 8 may be depicted by the schematic detail shown in FIG. 5, as indicated by the Detail 5 shown in FIG. 8. The aspect of the invention shown in FIGS. 6, 7, and 8—that is, the placement of aerators 10 prior to the formation of ice and/or snow layer 14—may provide similar benefits of exposure and fluid venting or escape as described with respect to FIGS. 4 and 5 above.

FIGS. 9 through 14 are schematic perspective views of further aerators that may be used as aerator 10 shown in and described with respect to FIGS. 1 through 8 according to aspects of the invention. FIG. 9 is a perspective view of an aerator 40 comprising a plurality of filaments or projections 42, for example, wire-like filaments, bar-like filaments or pin-like filaments, and the like. According to this aspect, 2 or more, 3 or more, or 4 or more filaments 42 may be provided. As shown, in one aspect, filaments 42 may be joined at one or more hubs or nexuses 44, for example, a single hub or nexus commonly joining each of the filaments 42. In one aspect, filaments 42 may have an outer width or diameter ranging from 0.10 inches to 1 inch, but may typically have an outer width or diameter from 0.125 inches to 0.25 inches. The filaments 42 may have an overall length ranging from 0.5 inches to 6 inches, but typically have a length ranging from 1 to 3 inches, for example, 2 inches. According to an aspect of the invention, one or more aerators 40 may be placed upon a surface as shown in FIGS. 2-4 and/or FIGS. 6-7 where the distal ends 46 of filaments 42 contact a surface and provide a projection for heating or warming and perforating the surface as disclosed herein.

FIG. 10 is a perspective view of an aerator 50 comprising a plurality of filaments or projections 52, for example, wire-like filaments, bar-like filaments or pin-like filaments, and the like, including a generally upright filament 54. In this aspect, generally upright filament 54 may provide a means for handling aerator 50. For example, in one aspect, filament 54 may include a knob, ring, or cap 56 adapted to be manually grasped by a user, for example, for placement or removal of aerator 50. According to this aspect, 2 or more, 3 or more, or 4 or more filaments 52 may be provided and one or more generally upright filaments 54 may be provided. As shown, in one aspect, filaments 52 and filament 54 may be joined at one or more hubs or nexuses 58, for example, a single hub or nexus 58 commonly joining each of the filaments 52. In one aspect, filaments 52 and 54 may have an outer width or diameter ranging from 0.10 inches to 1 inch, but typically may have an outer width or diameter from 0.125 inches to 0.25 inches. The filaments 52 and 54 may have an overall length ranging from 0.5 inches to 6 inches, but typically have a length ranging from 1 to 3 inches, for example, 2 inches. According to an aspect of the invention, one or more aerators 50 may be placed upon a surface as shown in FIGS. 2-4 and/or FIGS. 6-7 where the distal ends 59 of filaments 52 contact a surface and provide a projection for heating or warming and perforating the surface as disclosed herein.

FIG. 11 is a perspective view of an aerator 60 comprising one or more filaments or projections 62, for example, wire-like filaments, bar-like filaments or pin-like filaments, and the like, forming a spiral or helical shape, for example, a spring-like shape. Though in the aspect shown in FIG. 11, aerator 60 is shown having a generally circular cylindrical shape, according to aspects of the invention aerator 60 may have any cylindrical shape, including circular cylindrical, elliptical cylindrical, rectangular cylindrical, or square cylindrical.

In this aspect, a generally upright filament 64 (shown in phantom in FIG. 11) may be provided and provide a means for handling aerator 60. For example, in one aspect, filament 64 may include a knob, ring, or cap 66 (shown in phantom) adapted to be manually grasped by a user, for example, for placement or removal of aerator 60. In one aspect, aerator 60 may have an outer width or diameter of the spiral or helix ranging from 0.25 inches to 6 inches, but typically may have an outer width or diameter of the spiral or helix from 0.50 inches to 3 inches. In one aspect, filaments 62 of aerator 60 may have an outer width or diameter ranging from 0.10 inches to 1 inch, but may typically have an outer width or diameter from 0.125 inches to 0.25 inches. In one aspect, aerator 60 may have length of the spiral or helix ranging from 0.5 inches to 12 inches, but typically has a length ranging from 1 to 6 inches, for example, 3 inches in length. According to an aspect of the invention, one or more aerators 60 may be placed upon a surface as shown in FIGS. 2-4 and/or FIGS. 6-7 where the lower portions 68 of filaments 62 contact a surface and provide a structure for heating or warming and perforating the surface as disclosed herein.

FIG. 12 is a perspective view of an aerator 70 comprising one or more of filaments or projections 72, for example, wire-like filaments, bar-like filaments or pin-like filaments, and the like. According to this aspect, 1 or more generally upright filaments 72 may be provided and placed, for example, inserted into a surface to provide the desired aeration disclosed herein. In one aspect, generally upright filament 72 may be provided with a means for handling aerator 70. For example, in one aspect, filament 72 may include a knob, ring, or cap 74 adapted to be manually grasped by a user, for example, for placement or removal of aerator 70. In one aspect, filament 72 may have an outer width or diameter ranging from 0.10 inches to 1 inch, but typically may have an outer width or diameter from 0.125 inches to 0.25 inches. The filament 72 may have an overall length ranging from 0.5 inches to 6 inches, but typically has a length ranging from 1 to 3 inches, for example, 2 inches. According to an aspect of the invention, one or more aerators 70 may be placed upon a surface as shown in FIGS. 2-4 and/or FIGS. 6-7 where the distal ends 76 of filaments 72 contact and/or penetrate a surface and provide a source for heating or warming and perforating the surface as disclosed herein.

FIG. 13 is a perspective view of an aerator 80 comprising one or more of filaments or projections 82, for example, wire-like filaments, bar-like filaments, or pin-like filaments, and the like. According to this aspect, 1 or more filaments 82 may be provided and placed, for example, inserted into a surface to provide the desired aeration disclosed herein. As shown, in one aspect, two or more filaments 82 may be mounted or joined to one or more crossbars or cross filaments 84. In one aspect, a generally upright filament 86 may be provided to facilitate handling of aerator 80. Upright filament 86 may be provided with a means for handling aerator 80. For example, in one aspect, filament 86 may include a knob, ring, or cap 88 adapted to be manually grasped by a user, for example, for placement or removal of aerator 80. In one aspect, filament 82, upright filament 86, and cross filament 84 may have an outer width or diameter ranging from 0.10 inches to 1 inch, but typically may have an outer width or diameter from 0.125 inches to 0.25 inches. The filaments 82, 84, ad 86 may have an overall length ranging from 0.5 inches to 6 inches, but typically has a length ranging from 1 to 3 inches, for example, 2 inches. According to an aspect of the invention, one or more aerators 80 may be placed upon a surface as shown in FIGS. 2-4 and/or FIGS. 6-7 where the distal ends 89 of filaments 82 contact and/or penetrate a surface and provide a source for heating or warming and perforating the surface as disclosed herein.

FIG. 14 is a perspective view of an aerator 90 comprising two or more of filaments or projections 92, for example, wire-like filaments, bar-like filaments, or pin-like filaments, and the like. According to this aspect, 2 or more filaments 92 may be provided and placed, for example, inserted into a surface to provide the desired aeration disclosed herein. As shown, in one aspect, two or more filaments 92 may be mounted or joined to one or more crossbars or cross filaments 94. In one aspect, a generally upright filament 96 may be provided to facilitate handling of aerator 90. Upright filament 96 may be provided with a means for handling aerator 90. For example, in one aspect, filament 96 may include a knob, ring, or cap 98 adapted to be manually grasped by a user, for example, for placement or removal of aerator 90. In one aspect, filaments 92, cross filaments 94, and upright filament 96 may have an outer width or diameter ranging from 0.10 inches to 1 inch, but typically may have an outer width or diameter from 0.125 inches to 0.25 inches. The filaments 92, 94, and 96 may have an overall length ranging from 0.5 inches to 6 inches, but typically has a length ranging from 1 to 3 inches, for example, 2 inches. According to an aspect of the invention, one or more aerators 90 may be placed upon a surface as shown in FIGS. 2-4 and/or FIGS. 6-7 where the distal ends 99 of filaments 92 contact and/or penetrate a surface and provide a source of heating or warming and perforating the surface as disclosed herein.

Figure 15:
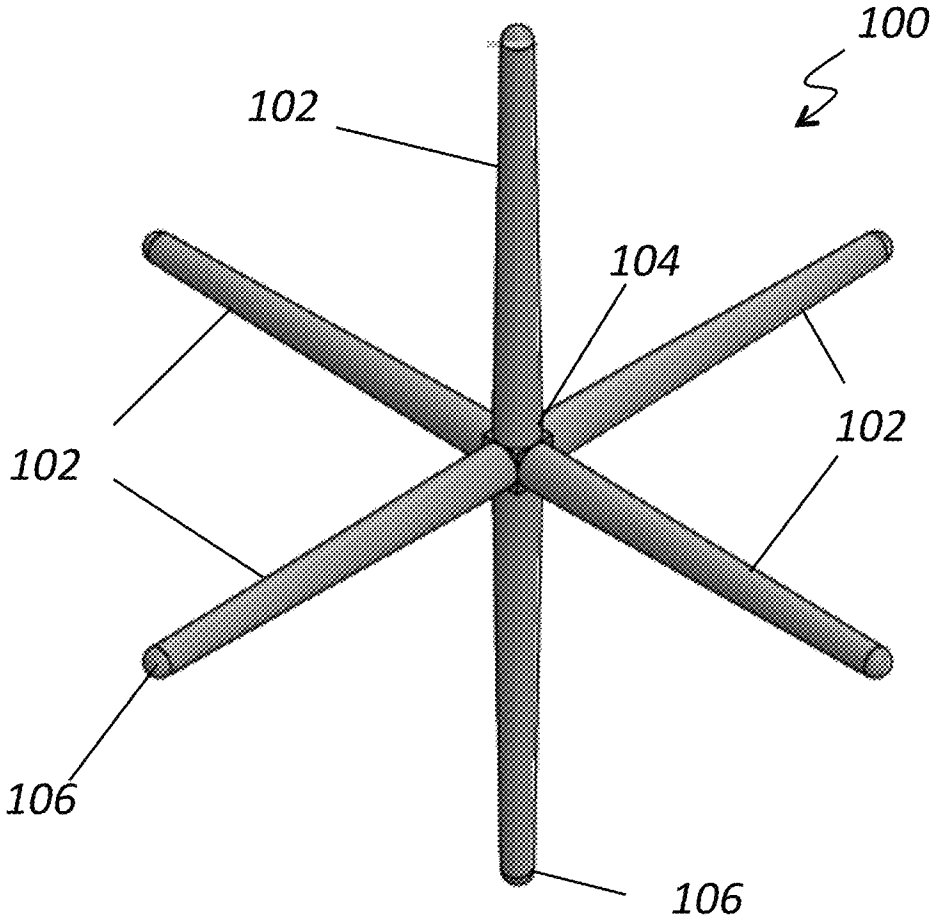
FIG. 15 is a perspective view of an aerator according to another aspect of the invention.
Figure 16:
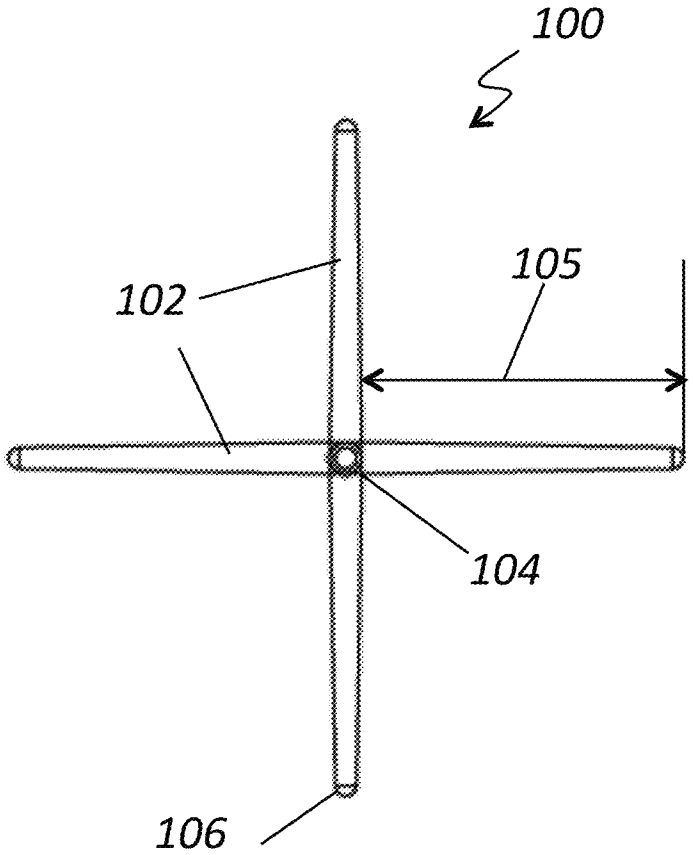
FIG. 16 is top plan view of the aerator shown in FIG. 15, the bottom view being a mirror image thereof.

FIG. 15 is a perspective view of a further aerator 100 that may be used as aerator 10 shown in and described with respect to FIGS. 1 through 8 according to aspects of the invention. FIG. 16 is top plan view of aerator 100 shown in FIG. 15, the bottom view being a mirror image thereof; and FIG. 17 is both a front elevation view and a side elevation view of aerator 100 shown in FIG. 15.

Similar in construction and function to the aerator 40 shown in FIG. 9, according to this aspect, aerator 100 includes or comprises a plurality of filaments, projections, or rods 102, for example, wire-like filaments, bar-like filaments, or pin-like filaments, and the like, mounted to a hub or central body 104. In one aspect, rods 102 may be radially directed from hub 104, though other oblique or non-radial orientations of rods 102 are envisioned. According to this aspect, 2 or more, 3 or more, or 4 or more rods 104 may be provided. In the aspect of the invention shown in FIGS. 15 through 17, aerator 100 includes 6 radially directed rods 102 from hub 104.

In one aspect, rods 102 may be cylindrical in shape, for example, circular cylindrical, polygonal cylindrical, or elliptical cylindrical. For example, in one aspect, rods 102 may be circular, elliptical, square, rectangular, or hexagonal in cross section. In one aspect, hub or central body may be cubic in shape, as shown in FIGS. 15 through 17, but may also be spherical, or any form of polyhedron, for example, a polyhedron having a number of facets corresponding to the number of rods 102 mounted to a polyhedral hub 104.

Figure 17:
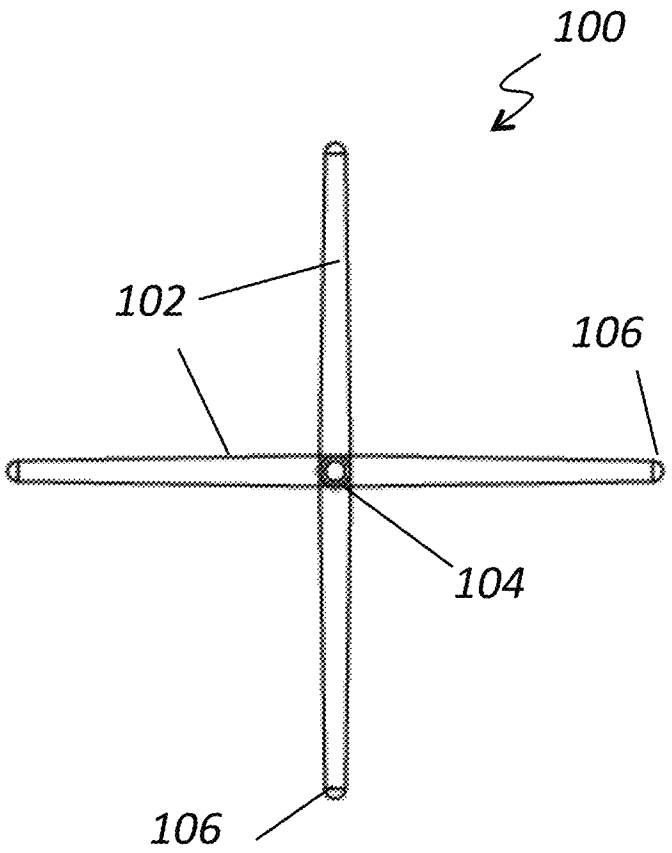
FIG. 17 is a front elevation view and a side elevation view of the aerator shown in FIG. 15.

In one aspect, rods 102 may have distal ends 106, and distal ends 106 may be planar or curvilinear, for example, hemispherical as shown in FIGS. 15 through 17.

Though not shown in FIGS. 15 through 17, in one aspect, aerator 100 may be provided with a means for handling aerator 100. For example, in one aspect, one or more of rods 102 may include a knob, ring, or cap (not shown), for example, a distal knob, ring, or cap positioned at a distal end 106 of a rod 102, adapted to be manually grasped by a user, for example, for placement or removal of aerator 100.

In one aspect, rods 102 of aerator 100 may have an outer width or diameter ranging from 0.10 inches to 1 inch, but typically may have an outer width or diameter from 0.125 inches to 0.25 inches. In another aspect, rods 102 may have an outer width or diameter that varies, for example, tapers, from a first outer width or diameter adjacent hub 104 to a second outer width or diameter at the distal end 106, for example, less than the first outer width or diameter. In one aspect, the second outer width or diameter at the distal end 106 may be greater than the first outer width or diameter at hub 104. For example, in one aspect, the first outer width or diameter of rods 102 at the hub 104 may range from 0.05 inches to 0.25 inches, for example, about 0.1625 inches (3/16 of an inch); and the second outer width or diameter of rods 102 at their distal end 106 may range from 0.05 inches to 0.25 inches, for example, about 0.125 inches (1/8 of an inch).

In one aspect, the outside width or diameter of hub 104 may be comparable to the outside width or dimension of rods 102 adjacent to hub 104. For example, in one aspect, the outer width or diameter of hub 104 may range from 0.05 inches to 0.25 inches, for example, about 0.1625 inches.

The rods 102 may have a length 105 (See FIG. 16) ranging from 0.5 inches to 6 inches, but typically have a length 105 ranging from 1 to 3 inches, for example, 2 inches. For example, in one aspect, the width between opposing distal ends 106 of rods 102 may range from 1 to 12 inches, but may typically be between 2 inches to 6 inches in over-all width.

According to an aspect of the invention, one or more aerators 100 may be placed upon a surface as shown in FIGS. 2-4 and/or FIGS. 6-7 where the distal ends 106 of rods 102 contact a surface and provide a source of heating or warming and perforating the surface as disclosed herein.

Figures 18, 19:
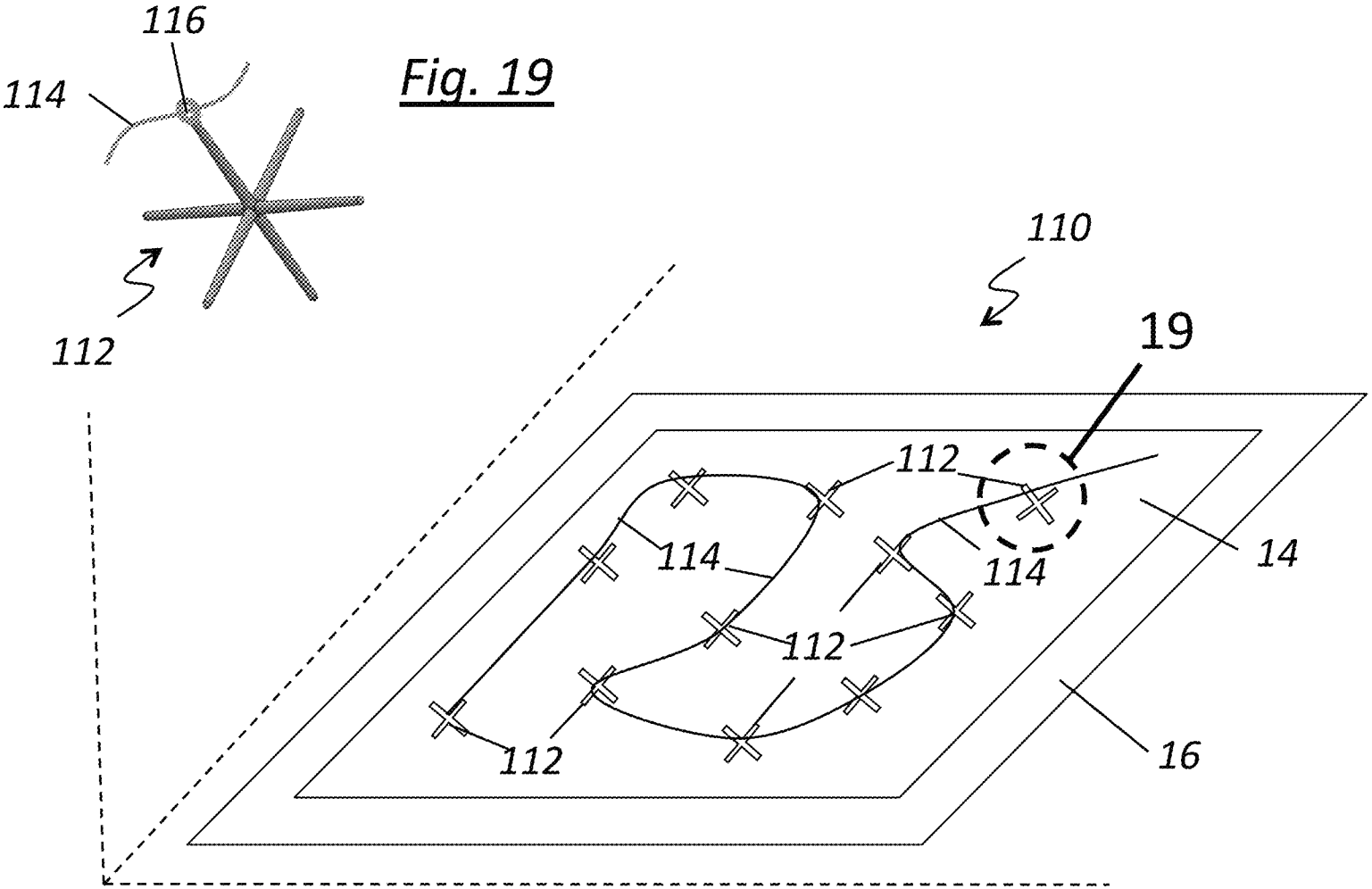
FIG. 18 is a schematic perspective view of another aspect of the invention having a system or apparatus having linked aerators.
FIG. 19 is a detailed view of one aerator of the system shown in FIG. 18 as identified by Detail 19 shown in FIG. 18 according to one aspect.

FIG. 18 is a schematic perspective view of another aspect of the invention having a system or apparatus 110 having linked aerators 112. In this aspect of the invention, aerators 112 of apparatus no may comprise any one or more of the aerators 10, 40, 60, 70, 80, 90, and/or 100 disclosed herein and be linked or connected by one or more linkages, bars, or filaments 114. For example, filament 114 may be a chain, a wire, a rope, a cable, or a string, among other filaments. In one aspect, filament 114 may include one or more electrical conductors, for example, which may power light sources, such as, light-emitting diodes (LEDs) and/or thermal elements on or within aerators 112. In one aspect, at least a portion of filament 114 may include one or more conductors adapted to conduct electrical current and/or radiate thermal energy (that is, heat) when energized sufficiently to melt adjacent ice and/or snow. For example, in one aspect, at least a portion of filament 114 and/or a portion of aerators 112 may comprise or function as an electrical heating element, high-resistance wire, or "thermal trace" and radiate thermal energy to the adjacent ice and/or snow when provided with electrical power.

FIG. 19 is a detailed view of one aerator 112 of system 110 shown in FIG. 18 as identified by Detail 19 in FIG. 18. As shown in FIG. 19, in one aspect, filament 114 of system 110 may engage one or more loops or rings 116 on aerator 112.

In one aspect, the one or more conductors 114 may be operatively connected to a source of power, for example, an electrical outlet or one or more photovoltaic elements. In one aspect, aerators 112 may comprise a photovoltaic device adapted to power one or more thermal sources mounted in or upon aerator 112.

Aspects of the invention, for example, any one of the aerators 10, 40, 60, 70, 80, 90, and/or 100 disclosed herein may be fabricated from a broad range of materials while providing the desired function. For example, aspects of the invention may be fabricated, from a wood, a plastic, a rubber, or a metal. In one aspect, an aerator as disclosed herein may be fabricated from a plastic, for example, a polyamide (PA), for example, nylon; a polyethylene (PE), both high-density polyethylene (HDPE) and low-density polyethylene (LDPE); a polyethylene terephthalate (PET); a polypropylene (PP); a polyester (PE); a polytetrafluoroethylene (PTFE); a polystyrene (PS); an acrylonitrile butadiene styrene (ABS); a polycarbonate (PC); or a polyvinylchloride (PVC); among other plastics.

In another aspect, an aerator as disclosed herein may be fabricated from a rubber or an elastomeric material, such as natural polymer, for example, polyisoprene rubber, or a synthetic polymer, such as, a neoprene, a thermoplastic elastomer, a thermoplastic rubber, and a polyvinyl chloride, or an ethylene propylene diene monomer (EPDM) rubber, and the like.

In another aspect, an aerator as disclosed herein may be fabricated from a metal, for example, iron, steel, stainless steel, aluminum, titanium, nickel, magnesium, brass, bronze, copper, silver, gold, or any other structural or ornamental metal.

Aspects of the invention, for example, any one of the aerators 10, 40, 60, 70, 80, 90, and/or 100 disclosed herein may comprise a color or surface texture that enhances the elevating of the temperature of the surface of the aerator, for example, increases the temperature rise of at least the distal ends of the filaments or rods of the aerator. For example, in one aspect, at least a portion of the filaments or rods may have an energy absorbing color, for example, black or a brown. In one aspect, the entire filament or the entire rod, or the entire aerator may comprise an energy absorbing color, such as, black or brown.

According to another aspects of the invention, a surface of any one of the aerators disclosed herein may comprise a surface enhancement or texture that enhances the elevating of the surface temperature of the aerator. For example, in one aspect, a least a portion of an aerator, for example, a portion of the filament or rod, such as a portion of the distal end of a filament or rod, may comprise one or more radial directed depressions or "flutes." In one aspect, the fluted filaments or rods, for example, the increased surface area of fluted filaments or rods, may enhance the absorption of thermal energy from the ambient conditions and enhance the distribution of thermal energy from the filaments or rods to enhance the melting of adjacent ice and/or snow. In another aspect, any one of the aerators disclosed herein may include one or more electrical heating elements, for example, one or more electrical heating elements positioned along or within a projection, rod, or filament, or upon or within an aerator hub.

As disclosed herein, systems, devices and methods are provided to aerate snow and/or ice covered surfaces, for example, vegetation covered surfaces, in order to enhance access of the surfaces to beneficial atmospheric conditions, such as, oxygen or temperature, and/or to release undesirable gases, such as, toxic carbon dioxide. While aspects of the invention may be particularly advantageous in aerating grass-covered surfaces, such as, lawns, fields, golf greens, tee boxes, and fairways, aspects of the invention may be applied to any surface that may benefit from appropriate exposure or aeration.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A method for aerating a surface covered with ice or snow, the method comprising:

prior to or after accumulation of snow or formation of ice upon the surface, distributing a plurality of aerators on to the surface or on to a top of the snow or ice, each of the plurality of aerators comprising a body having at least three projections, each of the at least three projections directed in one of a plurality of radial directions from a hub and oriented to contact the surface, to contact the top of the snow, or to contact the top of the ice;

exposing the aerators to ambient conditions wherein a temperature of at least a portion of one of the projections is increased to a temperature above freezing, wherein the at least a portion of one of the at least three projections melts a portion of the snow or ice exposing a portion of the surface to ambient air; and allowing ambient air to access the exposed portion of the surface to aerate the exposed portion of the surface.

2. The method as recited in claim 1, wherein distributing the plurality of aerators on to the surface or on to the top of the snow or ice comprises distributing the plurality of aerators on to the surface.

3. The method as recited in claim 1, wherein distributing the plurality of aerators on to the surface or on to the top of the snow or ice comprises distributing the plurality of aerators on to the top of the snow or ice.

4. The method as recited in claim 1, wherein exposing the aerators to ambient conditions comprises exposing the aerators to solar radiation.

5. The method as recited in claim 1, wherein the hub comprises a central hub, and each of the at least three projections are mounted to the central hub.

6. The method as recited in claim 1, wherein the method further comprises linking the plurality of aerators with a filament.

7. The method as recited in claim 6, wherein the filament comprises an electrical heating element, and wherein the method further comprises powering the electrical heating element to melt snow or ice adjacent the electrical heating element.

8. An aerator for aerating a surface covered with ice or snow, the aerator comprising a body having at least three projections, each of the at least three projections directed in one of a plurality of radial directions from a hub and oriented to contact the surface covered with ice or snow, to contact a top of the snow, or to contact a top of the ice, wherein, upon exposure of the aerator to ambient conditions, a temperature of at least a portion of one of the at least three projections is raised above a freezing temperature wherein at least a portion of one of the at least three heated projections melts a portion of the snow or ice exposing a portion of the surface to ambient air.

9. The aerator as recited in claim 8, wherein the at least three projections are mounted to the hub.

10. The aerator as recited in claim 8, wherein exposure of the aerator to ambient conditions raises the temperature of at least a portion of each of the at least three projections above the freezing temperature.

11. The aerator as recited in claim 8, wherein exposure of the aerator to ambient conditions raises the temperature of at least a distal end portion of each of the at least three projections above the freezing temperature.

12. The aerator as recited in claim 8, wherein the at least three projections comprise at least 4 projections.

13. The aerator as recited in claim 8, wherein at least a portion of one of the at least three projections comprises a surface having enhanced thermal absorption properties.

14. The aerator as recited in claim 13, wherein the enhanced thermal absorption properties comprise flutes.

15. The aerator as recited in claim 8, wherein the aerator further comprises an electrical heating element.

16. A kit for aerating a surface covered with ice or snow, the kit comprising a plurality of aerators, each of the plurality of aerators comprising a body having at least three projections, each of the at least three projections directed in one of a plurality of radial directions from a hub and oriented to contact the surface, to contact the top of the snow, or to contact a top of the ice; wherein, upon exposing the aerators to ambient conditions wherein a temperature of at least a portion of one of the projections is increased to a temperature above freezing, the at least a portion of one of the at least three projections melts a portion of the snow or ice exposing a portion of the surface to ambient air and allowing ambient air to access the exposed portion of the surface to aerate the exposed portion of the surface.

17. The kit as recited in claim 16, wherein the kit further comprises a filament adapted to link each of the plurality of aerators.

18. The kit as recited in claim 17, wherein the filament comprises at least one of a chain, a wire, a rope, a cable, and a string.

19. The kit as recited in any one of claim 16, wherein the kit further comprises instructions for using the kit.

20. The kit as recited in claim 18, wherein the filament comprises at least one electrical heating element.

* * * * *